US010427032B1

(12) United States Patent
Lin

(10) Patent No.: US 10,427,032 B1
(45) Date of Patent: Oct. 1, 2019

(54) EDUCATIONAL GAME BOX

(71) Applicant: Yu-Qin Lin, New Taipei (TW)

(72) Inventor: Yu-Qin Lin, New Taipei (TW)

(73) Assignee: Lonpos Braintelligent Co., Ltd., New Taipei (TW)

( * ) Notice: Subject to any disclaimer, the term of this patent is extended or adjusted under 35 U.S.C. 154(b) by 0 days.

(21) Appl. No.: 16/177,452

(22) Filed: Nov. 1, 2018

(51) Int. Cl.
*A63F 9/06* (2006.01)
*A63F 3/04* (2006.01)
*A63F 1/04* (2006.01)

(52) U.S. Cl.
CPC ..... *A63F 9/0666* (2013.01); *A63F 1/04* (2013.01); *A63F 3/04* (2013.01); *A63F 9/0611* (2013.01); *A63F 2001/0475* (2013.01)

(58) Field of Classification Search
CPC ..... A63F 9/0666; A63F 9/0611; A63F 3/04; A63F 1/04; A63F 2001/0475; A63F 9/0073
See application file for complete search history.

(56) References Cited

U.S. PATENT DOCUMENTS 2,659,163 A * 11/1953 Albee ..... A63F 9/0666 273/157 R
3,194,560 A * 7/1965 White ..... A63F 3/00643 273/139
3,945,645 A * 3/1976 Roberts ..... A63F 9/12 273/157 R
4,298,200 A * 11/1981 Kanbar ..... A63F 9/0669 273/148 A
4,474,371 A * 10/1984 Silbermintz ..... A63F 9/1204 273/153 S
4,988,103 A * 1/1991 Cheng ..... A63F 9/12 273/157 R
5,746,430 A * 5/1998 Chester ..... A63F 9/1044 273/157 R
5,988,640 A * 11/1999 Wheeler ..... A63F 3/00574 273/153 P
6,220,919 B1 * 4/2001 Cheng ..... A63F 9/12 273/153 P
6,637,745 B1 * 10/2003 Vardanyan ..... A63F 9/12 273/153 P
7,040,621 B2 * 5/2006 Cheng ..... A63F 9/12 273/157 R
8,020,867 B2 * 9/2011 Cheng ..... A63F 9/10 273/156

(Continued)

FOREIGN PATENT DOCUMENTS

TW 2012-M62109 * 8/2011
TW 2013-A97767 * 5/2012

*Primary Examiner* — Steven B Wong

(57) ABSTRACT

A game box for storing game properties and for single-player or two-player game, comprises a first box body, comprising a first base and a first building block base, the first base is provided with a first holding space, the first building block base covers the top of the first base, both ends of rear side are pin connected to both ends of rear side of the first base; an inserting holder, arranged at one end of the first box body, and there is a slot in the top surface of the inserting holder; at least one card, which can be inserted into the slot, and a pattern is printed on the surface of the card; and a first building block set, which can be laid in the locating recess holes of the first building block base.

9 Claims, 6 Drawing Sheets

(56) References Cited

U.S. PATENT DOCUMENTS

| | | | | |
|---|---|---|---|---|
| 8,480,449 | B2 * | 7/2013 | Cheng | A63F 9/1288<br>273/153 R |
| 2006/0076730 | A1 * | 4/2006 | Chiou | A63F 9/12<br>273/153 P |
| 2007/0187890 | A1 * | 8/2007 | Cheng | A63F 3/00<br>273/153 P |
| 2008/0274665 | A1 * | 11/2008 | Cheng | A63H 33/08<br>446/118 |

* cited by examiner

EDUCATIONAL GAME BOX

BACKGROUND OF INVENTION

1. Field of the Invention

The present invention relates generally to the field of educational games, and more particularly to a game box for single-player or two-player educational games.

2. Description of Related Art

Before the application for the present invention, the applicant had applied for multiple patents for building blocks or jigsaw pieces of educational games, e.g. Taiwan patent bulletins No. M429514, I370010 and M409879. However, these educational building blocks are provided for only one player, not for two players. Therefore, after multiple times of use, the player will be familiar with them and little interested in them, he is tired of them and unwilling to play anymore, so that the educational building blocks are likely to be eliminated, forming a waste.

On the other hand, the game box only provides a bottom box for storage, but the storage capacity of the bottom box is limited, it only holds the building blocks, there is no room for the solution manual or other properties, so it is inconvenient to be carried with.

In view of this, the research subject of the present invention is to develop a portable game box for storing game properties and for single-player or two-player tabletop games.

SUMMARY OF THE INVENTION

The purpose of the present invention is to overcome the deficiencies of the prior art and to provide a fixture block composite structure for workpiece positioning.

In order to solve the above technical problems, the present invention adopts the following technical solutions:

A game box, comprising: a first box body (1), including a first base (11) and a first building block base (12); wherein rear side and left and right sides of the first base (11) are provided with connected and upright first side walls (111), a first holding space (112) is located among the three first side walls (111), and the first building block base (12) covers the top of the first base (11), both ends of a rear side of the first building block base are pin connected to both ends of rear side of the first base (11); the top surface of the first building block base (12) is provided with multiple first locating recess holes (121), and the holes are connected to each other;

an inserting holder (2), located in one end of the first box body (1), arranged with the three first side walls (111) to make the first holding space (112) square; the top surface of the inserting holder (2) is provided with a slot (21);

at least a card (3), one end of it can be inserted in the slot (21), and a pattern (31) is printed on both sides of the card (3) respectively; and a first building block set (4), comprising multiple building blocks, and each building block comprises multiple elements connected in one to form different shapes; the multiple building blocks can be laid in the first locating recess holes (121) of the first building block base (12) to fill all of the locating recess holes (121).

More particularly, wherein the game box (10) has a first switch button (5) for starting/stopping the first building block base (12), the first switch button (5) can be located on one side edge of the first box body (1) or one side edge of the inserting holder (2).

More particularly, comprises a first press cap (51) and a first spring (52) located in the bottom of the first press cap (51); one end of the first press cap (51) is provided with a first buckling hole (511), and a first clamping lug (122) which can be embedded in the first buckling hole (511) is located in one end of the first building block base (12) corresponding to the first buckling hole (511).

More particularly, wherein a first elastic element (113) for upspringing the first building block base (12) is located in the first base (11).

More particularly, wherein the game box (10) has a card bed (6) which can be put in the slot (21), the top surface of the card bed (6) is provided with a notch (61) for inserting the card (3), and there are upright retaining walls (62) on the left and right sides of top surface; a ⊔-shaped gap (63) is formed among the retaining walls (62) and the notch (61).

More particularly, wherein the game box (10) has a second box body (7) and a second building block set (8); the second box body (7) is arranged at the other end of the inserting holder (2), in mirror symmetry to the first box body (1), and the second box body (7) comprises a second base (71) and a second building block base (72), the rear side and left and right sides of the second base (71) are provided with connected and upright second side walls (711), a second holding space (712) is located among the three second side walls (711), and the second building block base (72) covers the top of the second base (71), both ends of rear side of the second building block base are pin connected to both ends of rear side of the second base (71); the top surface of the second building block base (72) is provided with several second locating recess holes (721) which are connected to each other;

the second building block set (8) comprises multiple building blocks, and each building block comprises multiple elements connected in one to form different shapes; the multiple building blocks can be laid in the first locating recess holes (721) of the first building block base (72) to fill all of the locating recess holes (121).

More particularly, the game box (10) has a second switch button (9) for starting/stopping the second building block base (72), the second switch button (9) can be located on one side edge of the second box body (7) or one side edge of the inserting holder (2).

More particularly, the second switch button (9) comprises a second press cap (91) and a second spring (92) located at the bottom of the second press cap (91). One end of the second press cap (91) is provided with a second buckling hole (911), a second clamping lug (722) which can be embedded in the second buckling hole (911) is located in one end of the second building block base (72) corresponding to the second buckling hole (911).

More particularly, a second elastic element (713) for upspringing the second building block base (72) is located in the second base (71).

The implementation of the present invention has the following effects:

1. The present invention can be played by one person or two persons together, the content and gameplay of the game can be enhanced, and the consumer buying desire can be stimulated.

2. Based on the design of the first box body and the second box body, the game box of the present invention is easy to store and carry, free from site constraints, it is playable everywhere.

3. The card and the first and the second building block set of the present invention are put in the first and the second holding space respectively, which can be covered with the first and the second building block base for protection, dust prevention and loss prevention.

DETAILED DESCRIPTION OF THE INVENTION

Figure 1:
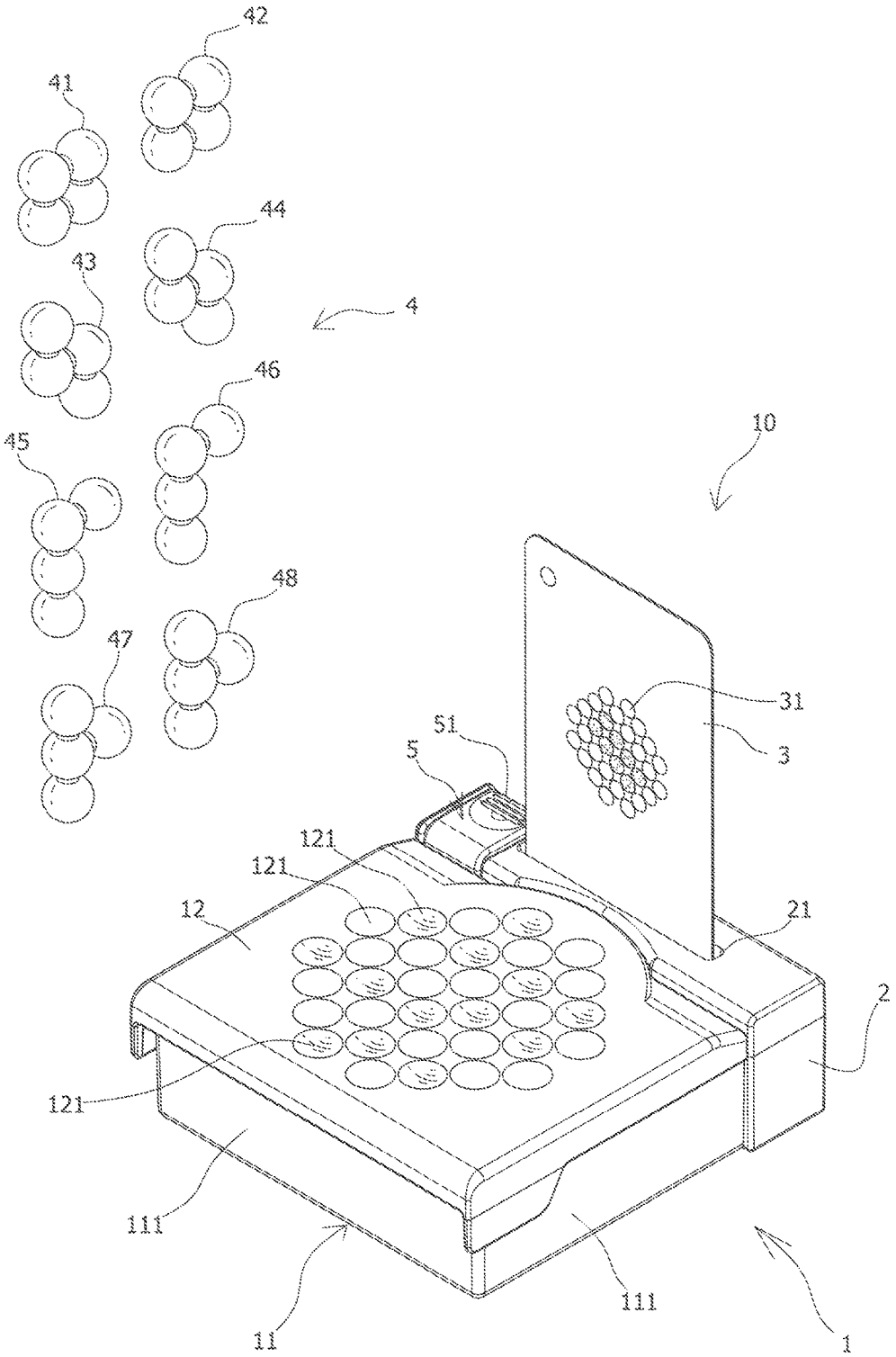
FIG. 1 is a three-dimensional diagram of the first implementation pattern of the present invention.
Figure 2:
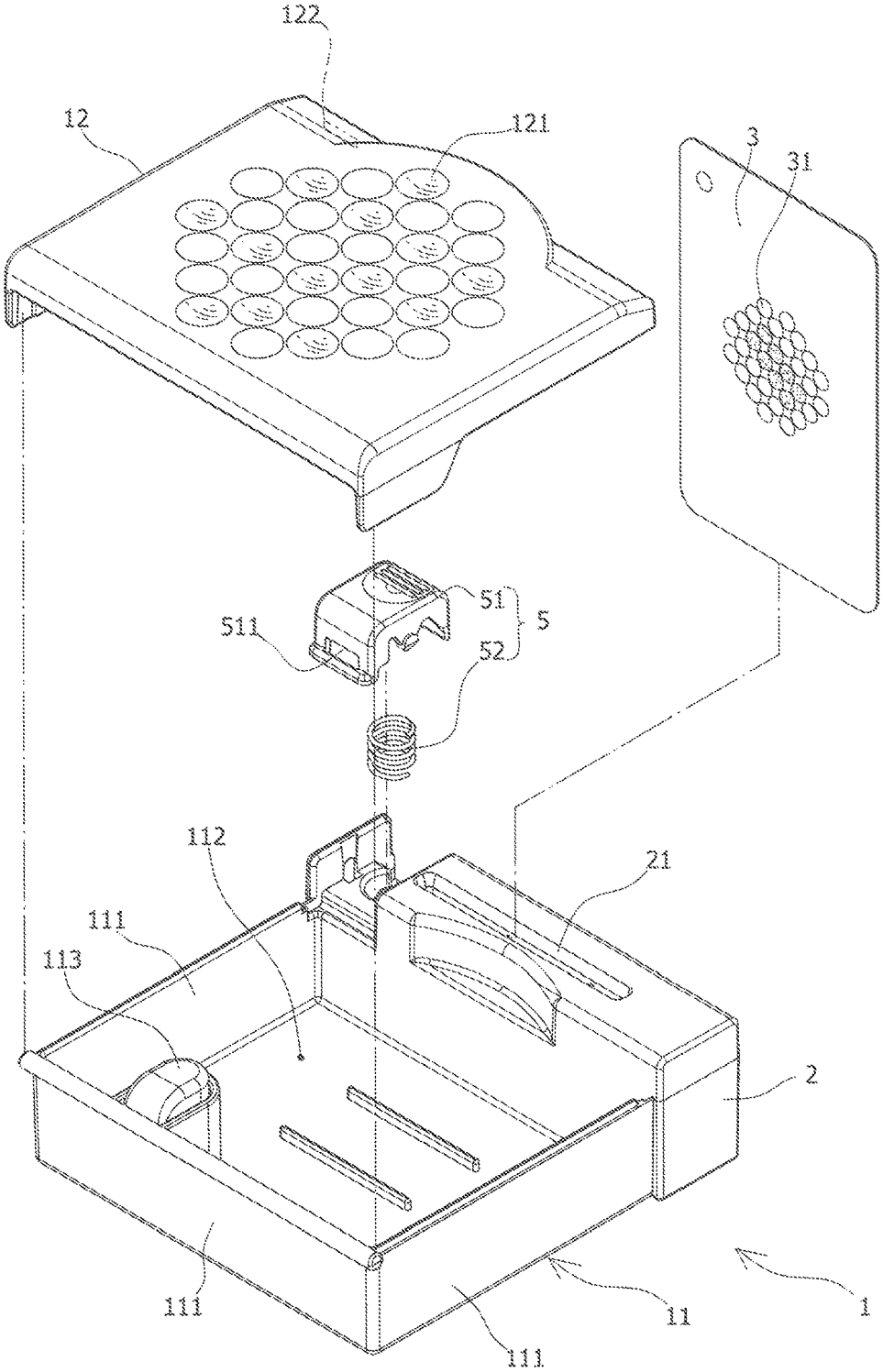
FIG. 2 is an exploded view of the first implementation pattern of the present invention.

The embodiments shown in the figures are elaborated below:

The present invention has two implementation patterns. The first implementation pattern is shown in FIGS. 1 and 2, which disclose a game box 10, comprising a first box body 1, which comprises a first base 11 and a first building block base 12, the rear side and left and right sides of the first base 11 are provided with connected and upright first side walls 111, a first holding space 112 is located among the three first side walls 111, the first building block base 12 covers the top of the first base 11, and both ends of a rear side of the first building block base are pin connected to both ends of rear side of the first base 11 respectively, the top surface of the first building block base 12 is provided with several first locating recess holes 121, the holes are shallow arc holes, and the holes are connected to each other; an inserting holder 2, located in one end of the first box body 1, arranged with the three first side walls 111, so as to make the first holding space 112 square or rectangular, a slot 21 is located in the top surface of the inserting holder 2; at least a card 3, one end of it can be inserted in the slot 21, and a pattern 31 is printed on both sides of card 3 respectively; and a first building block set 4, which comprises multiple building blocks, and each building block consists of multiple elements connected up to form different shapes. The multiple building blocks can be laid in the first locating recess holes 121 of the first building block base 12, and all of locating recess holes 121 are filled. As shown in the figures, the first building block set 4 has eight building blocks 41-48, each building block comprises four spherical elements in one. The 8 building blocks 41-48 have 32 elements, which can be exactly laid in the preset 32 first locating recess holes 121 of the first building block base 12. As the building blocks have different shapes, the user's brain storming is required for filling. The number of building blocks forming the first building block set 4 is not limited to eight, and the total number of elements is not limited to 32, the shapes of building blocks are not limited to the shapes shown in the figures, but the total number of elements of the first building block set 4 must be equal to the total number of the preset first locating recess holes 121 of the first building block base 12.

One of the card 3 can be inserted in the slot 21 of the inserting holder 2, so that the player can see the pattern 31 on the card 3 clearly. Afterwards, according to the pattern 31 disclosed on the card 3, the player puts a building block of the first building block set 4 corresponding to the pattern 31 in the first locating recess holes 121 of the first building block base 12 corresponding to the pattern 31, and then chooses the second building block from the first building block set 4 to fill the first locating recess holes 121 of the first building block base 12 without a building block, so as to complete the challenge. This is the play for one player.

Figure 3:
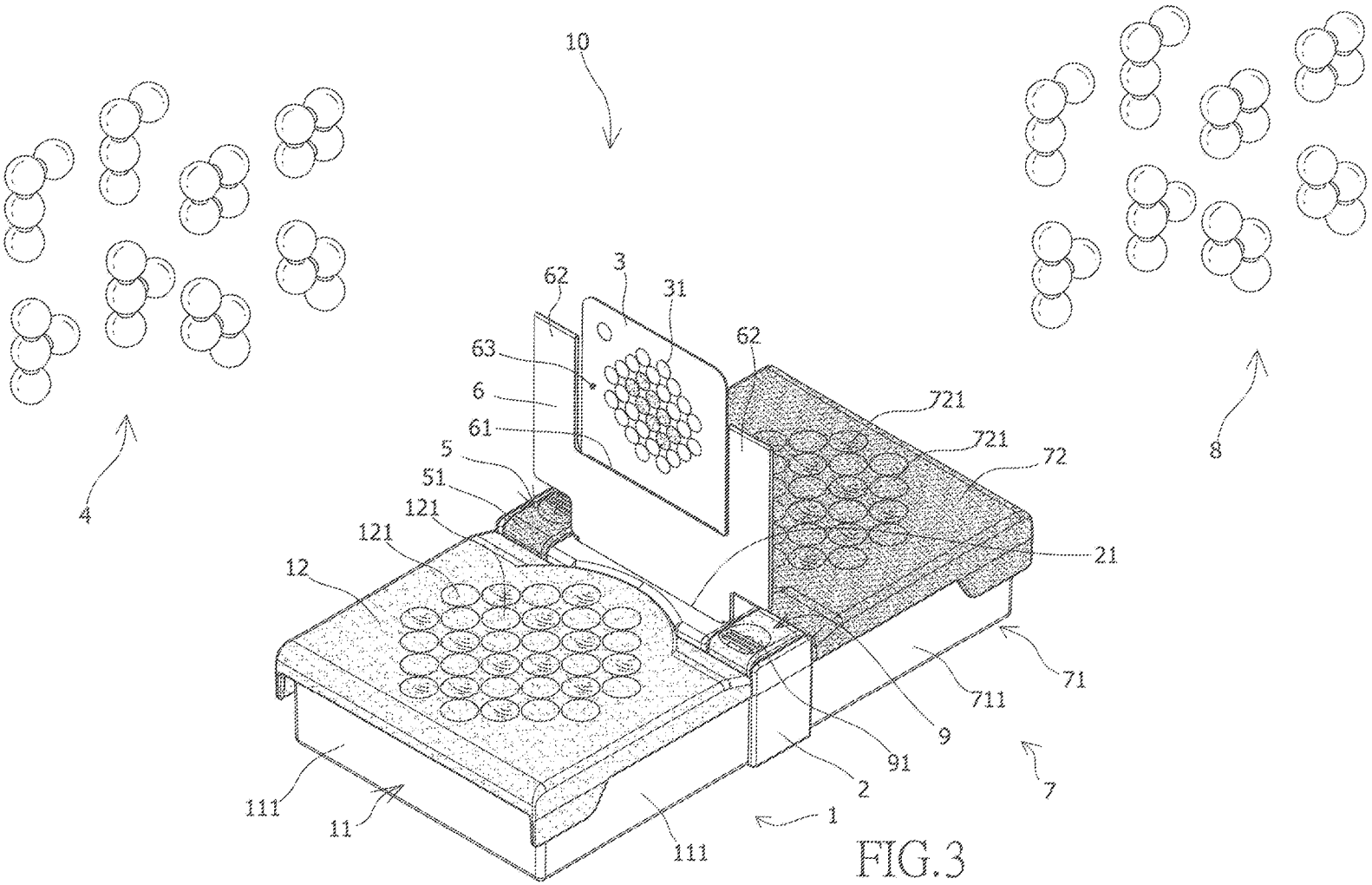
FIG. 3 is a three-dimensional diagram of the second implementation pattern of the present invention.

Afterwards, the second implementation pattern is introduced, as shown in FIG. 3, the game box 10 has a second box body 7 and a second building block set 8. The second box body 7 is located in the other end of the inserting holder 2, and in mirror symmetry to the first box body 1. The second box body 7 comprises a second base 71 and a second building block base 72. The rear side and left and right sides of the second base 71 are provided with connected and upright second side walls 711. A second holding space 712 is located among the three second side walls 711. The second building block base 72 covers the top of the second base 71, and both ends of a rear side of the second building block base are pin connected to both ends of rear side of the second base 71 respectively. The top surface of the second building block base 72 is provided with several second locating recess holes 721 connected to each other. The second building block set 8 comprises multiple building blocks, and each building block comprises multiple elements connected in one to form different shapes. The multiple building blocks can be laid in the first locating recess holes 721 of the first building block base 72 to fill all of locating recess holes 721.

The second implementation pattern is differentiated from the first implementation pattern by a second box body 7 in the other end of inserting holder 2 and an additional second building block set 8, so that two persons can play the game together. In terms of the play, one of the card 3 is inserted in the slot 21 of the inserting holder 2, so that both players can see the pattern 31 on the card 3 clearly, and according to the pattern 31 on card 3, each player puts a building block of his first building block set 4 or second building block set 8 corresponding to the pattern 31 in the first locating recess holes 121 or second locating recess holes 721 corresponding to the pattern 31, and then chooses the second building block from the first building block set 4 or the second building block set 8 to fill the first locating recess holes 121 or second locating recess holes 721 without a building block, the holes are filled successively. The player who finishes the filling first is the winner, this is the play for two players.

The design of the first box body 1 and the second box body 7 is available for two persons to play the game together, and it is convenient for storing game properties, portable and free from site constraints, playable everywhere.

Figure 4:
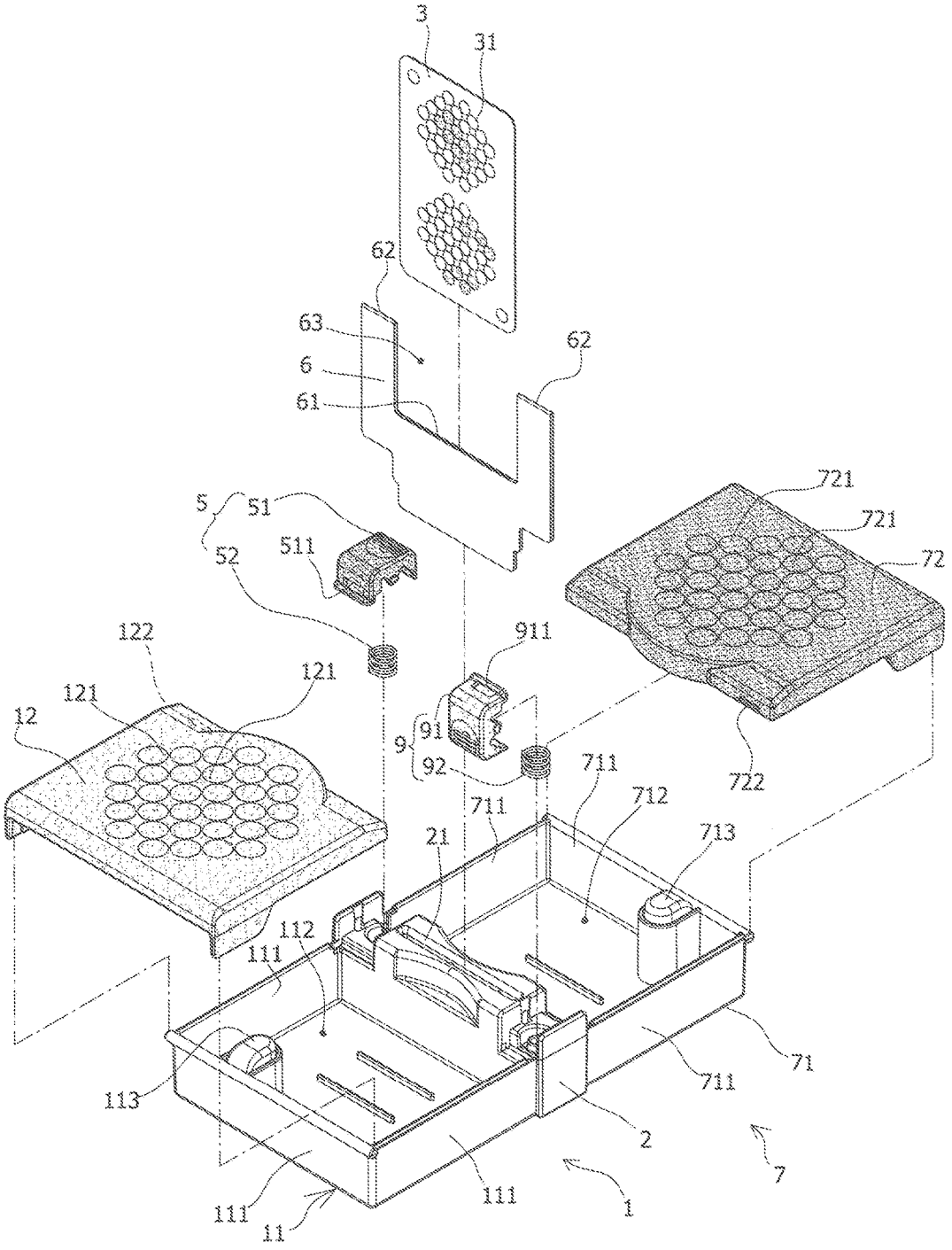
FIG. 4 is an exploded view of the second implementation pattern of the present invention.
Figure 5:
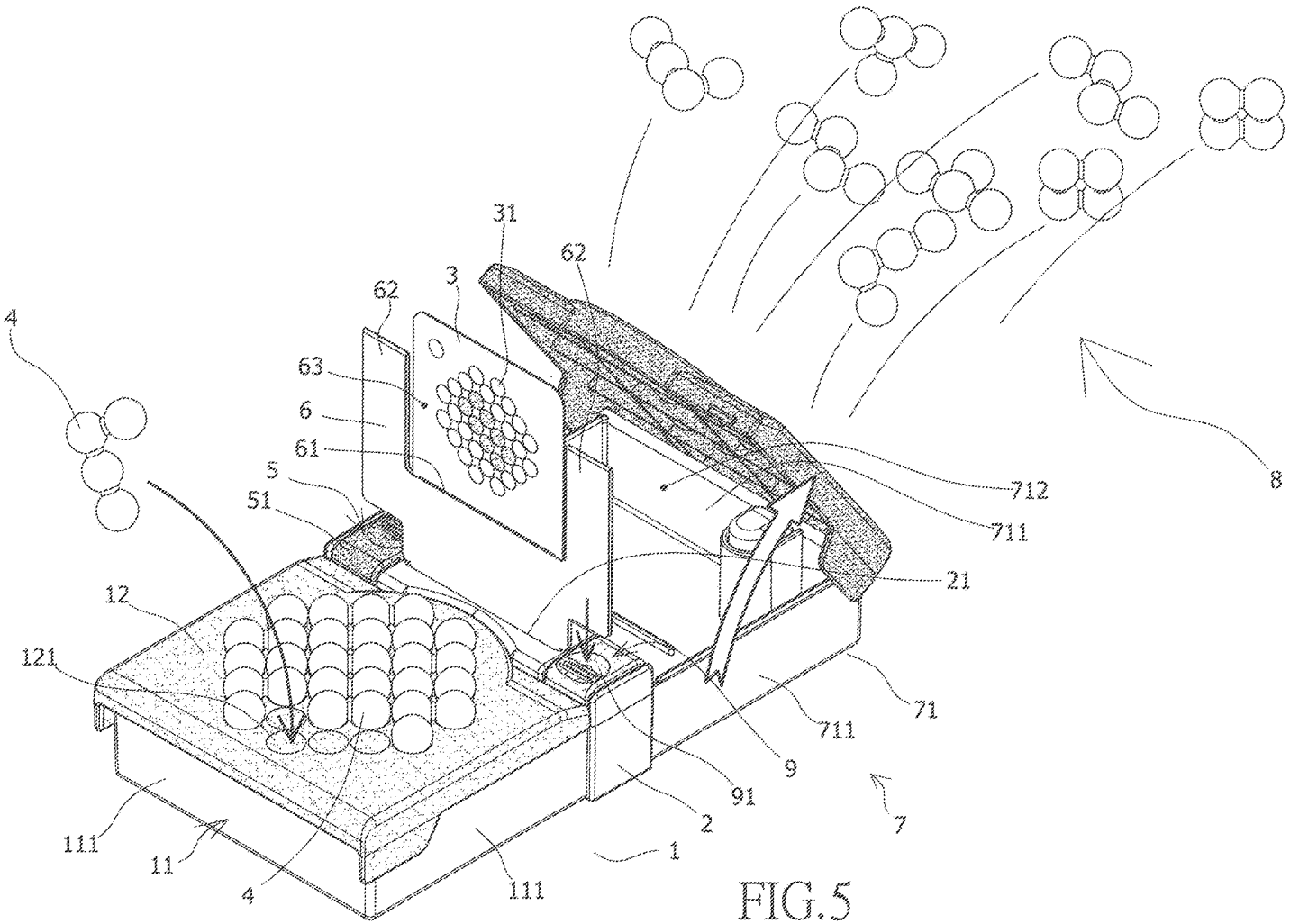
FIG. 5 is a schematic diagram of the second implementation pattern of the present invention.

As shown in FIGS. 4 and 5, the game box 10 has a first and a second switch button 5, 9 for starting/stopping the first and the second building block base 12, 72 respectively. The first and the second switch 5, 9 can be located on one side edge of the first and the second box body 5, 9 or one side edge of the inserting holder 2, and the first and the second switch button 5, 9 comprise a first and a second press cap 51, 91 and a first and a second spring 52, 92 located in the bottoms of the first and the second press cap 51, 91 respectively. One end of the first and the second press cap 51, 91 is provided with a first and a second buckling hole 511, 911 respectively, and a first and a second clamping lug 122, 722 which can be embedded in the first and the second buckling hole 511, 911 are located in one end of the first and the second building block base 12, 72 corresponding to the first and the second buckling hole 511, 911 respectively. A first elastic element 113 for upspringing the first building block base 12 is located in the first base 11. A second elastic element 713 for upspringing the second building block base 72 is located in the second base 71. The first and the second elastic element 113, 713 comprise an ejection block and a spring under the ejection block (not disclosed) respectively.

When the first and the second switch button 5, 9 are pressed, one end of the first and the second switch button 5, 9 rises up, the first and the second clamping lug 122, 722 slide out of the first and the second buckling hole 511, 911, and the first and the second elastic element 113, 713 pressed by the first and the second building block base 12, 72 generate an upward thrust to eject the first and the second building block base 12, 72 upwards.

Secondly, the first switch button 5 and the first building block base 12 can be of the same color, and the second switch button 9 and the second building block base 72 can be of the same color, so that the players can identify the switch buttons corresponding to their building block bases.

As stated above, with the first and the second switch button 5, 9 and the first and the second elastic element 113, 713, when two persons play the game together, the player who fills the first building block set 4 or the second building block set 8 in the first locating recess holes 121 or the second locating recess holes 721 without a building block first can press the first switch 5 or the second switch 9 quickly, so that the opponent's first building block base 12 or second building block base 72 is pushed up by elastic element 113 or elastic element 713 and ejected instantaneously when one end is not fixed, and the first building block set 4 or the second building block set 8 drops off the first building block base 12 or the second building block base 72, the play cannot continue, the victory or defeat is known. For example, there are two game players A and B, Player A uses the first box body 1 and the first building block set 4, and Player B uses the second box body 7 and the second building block set 8. Player A finishes the arrangement of the first building block set 4 on the first building block base 12 earlier than Player B in the game, so he can press the second switch 9 of the second box body 7 quickly, the second building block base 72 is ejected instantaneously, and Player B cannot lay the building blocks anymore, so as to determine the winner for recreation.

FIGS. 3-5 disclose that the game box 10 has a card bed 6 which can be put in the slot 21. The top surface of the card bed 6 is provided with a notch 61 for the card 3, and there are upright retaining walls 62 on the left and right sides of top surface. A ⊔-shaped gap 63 is formed among the ⊔ retaining walls 62 and the notch 61; so the bottom of the card 3 can be inserted in the notch 61, the retaining walls 62 on both sides as support prevent the card 3 from sliding off both sides or tilting during play.

Figure 6:
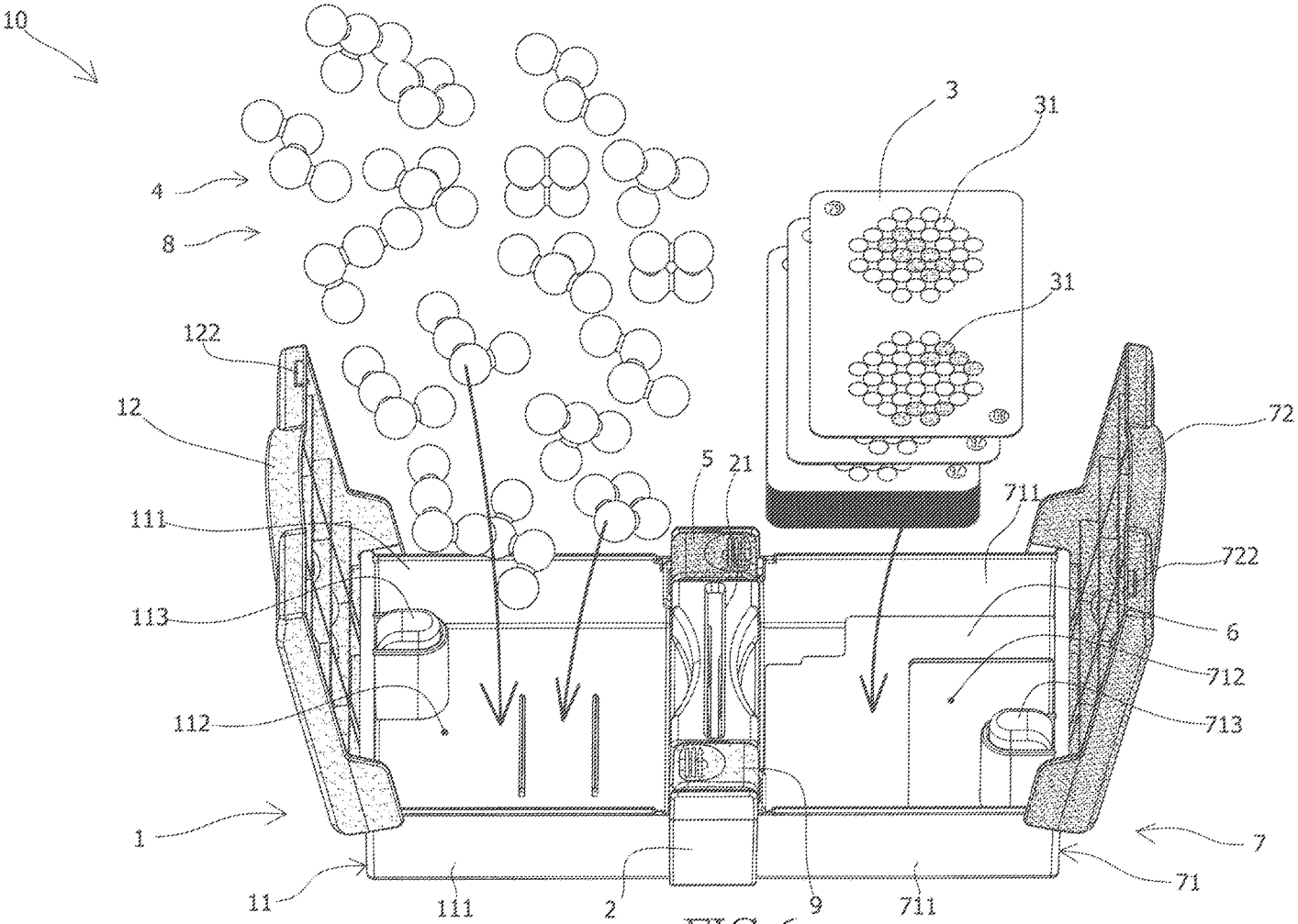
FIG. 6 is a three-dimensional diagram of the first and the second building block base opened in the second implementation pattern of the present invention.

As shown in FIG. 6, the card 3, the card bed 6 and the first and the second building block set 4, 8 can be put in the first and the second holding space 112, 712 respectively, covered with the first and the second building block base 12, 72 for protection, dust prevention and loss prevention.

The above only describes some exemplary embodiments of the present invention. Those having ordinary skills in the art may also make many modifications and improvements without departing from the conception of the invention, which shall all fall within the protection scope of the invention.

I claim:

1. A educational game box, comprising:

a first box body (1), including a first base (11) and a first building block base (12); wherein rear side and left and right sides of the first base (11) are provided with connected and upright first side walls (111), a first holding space (112) is located among the three first side walls (111), and the first building block base (12) covers the top of the first base (11), both ends of a rear side of the first building block base (12) are pin connected to both ends of rear side of the first base (11); the top surface of the first building block base (12) is provided with multiple first locating recess holes (121), and the holes are connected to each other;

an inserting holder (2), located in one end of the first box body (1), arranged with the three first side walls (111) to make the first holding space (112) square; the top surface of the inserting holder (2) is provided with a slot (21);

at least a card (3), one end of the card can be inserted in the slot (21), and a pattern (31) is printed on both sides of the card (3) respectively; and a first building block set (4), comprising multiple building blocks, and each building block comprises multiple elements connected in one to form different shapes; the multiple building blocks can be laid in the first locating recess holes (121) of the first building block base (12) to fill all of the locating recess holes (121).

2. The educational game box defined in claim 1, wherein the game box (10) has a first switch button (5) for starting/stopping the first building block base (12), the first switch button (5) can be located on one side edge of the first box body (1) or one side edge of the inserting holder (2).

3. The educational game box defined in claim 2, wherein the first switch button (5) comprises a first press cap (51) and a first spring (52) located in the bottom of the first press cap (51); one end of the first press cap (51) is provided with a first buckling hole (511), and a first clamping lug (122) which can be embedded in the first buckling hole (511) is located in one end of the first building block base (12) corresponding to the first buckling hole (511).

4. The educational game box defined in claim 1, wherein a first elastic element (113) for upspringing the first building block base (12) is located in the first base (11).

5. The educational game box defined in claim 1, wherein the game box (10) has a card bed (6) which can be put in the slot (21), the top surface of the card bed (6) is provided with a notch (61) for inserting the card (3), and there are upright retaining walls (62) on the left and right sides of top surface; a ⊔-shaped gap (63) is formed among the retaining walls (62) and the notch (61).

6. The educational game box defined in claim 1, wherein the game box (10) has a second box body (7) and a second building block set (8); the second box body (7) is arranged at the other end of the inserting holder (2), in mirror symmetry to the first box body (1), and the second box body (7) comprises a second base (71) and a second building block base (72), the rear side and left and right sides of the second base (71) are provided with connected and upright second side walls (711), a second holding space (712) is located among the three second side walls (711), and the second building block base (72) covers the top of the second base (71), both ends of rear side of the second building block base (72) are pin connected to both ends of rear side of the second base (71); the top surface of the second building block base (72) is provided with several second locating recess holes (721) which are connected to each other;

the second building block set (8) comprises multiple building blocks, and each building block comprises multiple elements connected in one to form different shapes; the multiple building blocks can be laid in the first locating recess holes (721) of the first building block base (72) to fill all of the locating recess holes (121).

7. The educational game box defined in claim 6, the game box (10) has a second switch button (9) for starting/stopping the second building block base (72), the second switch button (9) can be located on one side edge of the second box body (7) or one side edge of the inserting holder (2).

8. The educational game box defined in claim 7, the second switch button (9) comprises a second press cap (91) and a second spring (92) located at the bottom of the second press cap (91); one end of the second press cap (91) is provided with a second buckling hole (911), a second clamping lug (722) which can be embedded in the second buckling hole (911) is located in one end of the second building block base (72) corresponding to the second buckling hole (911).

9. The educational game box defined in claim 6, a second elastic element (713) for upspringing the second building block base (72) is located in the second base (71).

* * * * *